United States Patent [19]

Schmidt

[11] 4,100,979

[45] Jul. 18, 1978

[54] PNEUMATIC PERCUSSION BORING DEVICE

[76] Inventor: Paul Schmidt, Reiherstrasse, Lennestadt, Fed. Rep. of Germany, 594

[21] Appl. No.: 751,970

[22] Filed: Dec. 17, 1976

[30] Foreign Application Priority Data

Dec. 27, 1975 [DE] Fed. Rep. of Germany ..... 2558842

[51] Int. Cl.[2] ..... E21B 11/02

[52] U.S. Cl. ..... 175/19; 175/390

[58] Field of Search ..... 175/19–22, 175/389, 390

[56] References Cited

U.S. PATENT DOCUMENTS

| | | | |
|---|---|---|---|
| 2,262,001 | 11/1941 | Hokanson | 175/390 |
| 2,648,524 | 8/1953 | Dionisotti | 175/390 X |
| 3,970,157 | 7/1976 | Schmidt | 175/22 |

FOREIGN PATENT DOCUMENTS

| | | | |
|---|---|---|---|
| 555,029 | 1/1957 | Italy | 175/390 |

*Primary Examiner*—Ernest R. Purser
*Assistant Examiner*—Richard E. Favreau
*Attorney, Agent, or Firm*—Toren, McGeady and Stanger

[57] ABSTRACT

A pneumatic percussion boring device, which is particularly intended for boring tunnel-like holes in the ground, comprises a percussion boring tool which is mounted in a tubular housing, a percussion piston which, in operation, reciprocates in the housing and acts on the tool, and a displacement piece which is mounted on the boring tool for laterally displacing the soil through which the boring is being made. The displacement piece tapers in the direction of boring and is formed around its periphery with a series of annular cutting edges. The displacement piece is preferably stepped with each step being of an increasing diameter in a rearward direction with one of the cutting edges extending around the outer periphery of each step. The forwardly directed face of each step may be undercut with a concave annular depression which increases the sharpness of the cutting edge at the outside of the step.

6 Claims, 5 Drawing Figures

PNEUMATIC PERCUSSION BORING DEVICE

This invention relates to pneumatic percussion boring devices for use, for example, for ground boring and comprising a percussion boring tool which is mounted in a tubular housing, a percussion piston which, in operation, reciprocates in the housing and acts on the tool, and a displacement piece which is mounted upon the tool and tapers in the direction of boring, that is in a direction away from the piston.

Such boring devices are known, for example, from German Patent Specification No. 2,157,259. They are used predominantly in the laying of supply lines such as water piping or electric cables beneath roads or embankments, without the need for excavating the road surfacing and subsoil. This can be done because the boring device moves through the soil and displaces it laterally, so that the housing which is generally of circular cross-section leaves behind it a small tunnel of circular cross-section, through which supply lines can be drawn either as the boring progresses or later. During the advance of the boring device through the ground, the percussion tool shatters stones or other solid obstructions, while the function of the displacement piece, which is conical, is to deflect the soil sideways and to form a cavity having a compacted side wall. In general, the maximum diameter of the displacement piece is approximately the same as the external diameter of the tubular housing, so that the displacement piece forms a tunnel which is approximately equal in diameter to the outside of the tubular housing. In this way, a very high friction force is produced between the housing and the wall of the tunnel, so that the percussion boring device can only be moved forwards with extremely high forces. The larger the percussion boring device, that is the greater its external circumference, the larger are the forces required.

In order to reduce the friction between the housing and the soil and thus to facilitate driving, the forward part of the housing in the known percussion boring devices carries a ring having a greater diameter than the remainder of the housing. This ring tapers to fit the front part of the housing in the direction of operation of the percussion tool and displaces the soil in such a way that a tunnel or duct having a larger diameter than the housing is produced in the soil and thus the friction between the housing as a whole and the soil is considerably reduced. Practice has, however, shown that the ring mounted upon the forward part of the housing does not operate satisfactorily, in spite of having some advantages. In particular, this is attributable to the fact that very high forces act upon the ring and this leads to rapid wear and failure.

The aim of the present invention is to provide a pneumatic percussion boring device as initially described, which with the aid of simple means makes more rapid boring possible and ensures good productivity results.

To this end, according to this invention, such a boring device is provided with a displacement piece which is provided around its periphery with knife-like cutters.

It has surprisingly been found that with this arrangement the loading on the displacement piece is distributed over the cutters. As a result, wear of the cutters is substantially reduced, so that the displacement piece has a considerably longer working life. Furthermore, the boring action is favourably influenced by the knife-like cutters, since the cutters very rapidly disintegrate solid obstructions such as stones.

It is possible to insert cutters of an especially hard material in the displacement piece, for example in the form of closed cutting rings, which can be fixed on the displacement piece. Preferably, however, the cutters are formed integrally with the displacement piece. It has proved especially advantageous for the cutter to have a circumferential, hollow conical undercut.

An especially good distribution of the forces which occur at the displacement piece is obtained if the cutters are arranged so that they are stepped back one behind another. The outermost circumferential edges may then lie in axial section either upon a straight line or upon a curved line or envelope curve. The form and arrangement of the cutters will depend upon the subsoil to be penetrated and also upon the size of the tunnel or duct to be produced.

The ratio of radial height to axial length of each cutter may with advantage be about 1:3. It has also proved especially advantageous if the axial length and preferably also the radial height of each cutter is greater towards the end of larger diameter of the displacement piece than the axial length and radial height of each adjacent cutter on the forward side.

An example of a percussion boring device in accordance with the invention, together with a number of examples of displacement pieces with which the device can be fitted, are illustrated in the accompanying drawings, in which.

Figure 1:
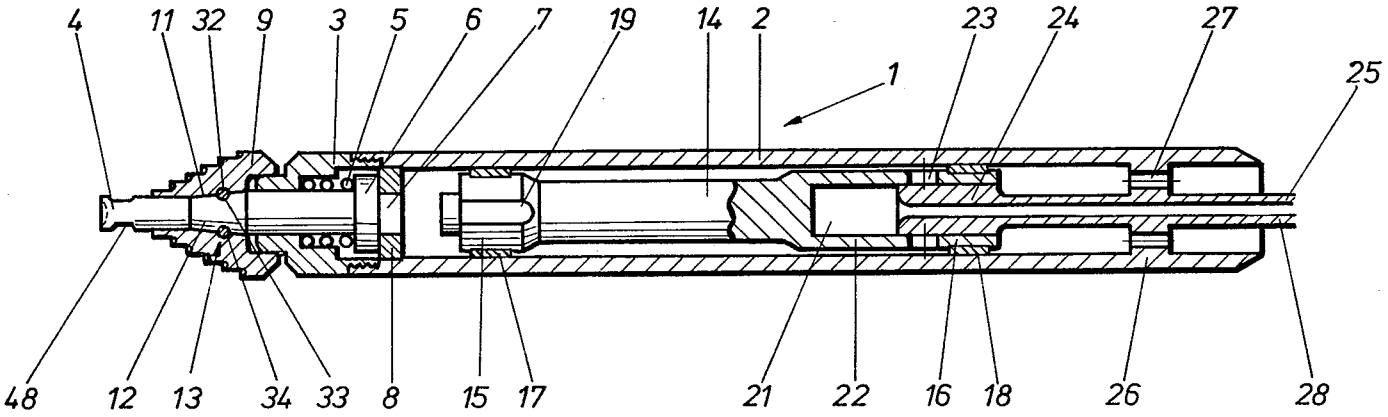
FIG. 1 is a longitudinal section through the device.

A percussion boring device 1, shown in FIG. 1, comprises a cylindrical tubular housing 2, in the forward end of which a bush 3 is screwed. A percussion tool 4 is axially displaceably mounted in the bush 3. The percussion tool 4 is subject to the action of a spring 5, engaging upon a head 6 of the percussion tool 4. On the side of the head 6 remote from the spring 5, there is a spigot 7, which fits in a disc 8 inserted in the housing 2. The percussion tool 4 has at its front end outside the housing 2, a forwardly tapering displacement piece 9, which has a central bore 11 seated upon a conical seat 12 of the percussion tool 4. A fixing device 13, explained in more detail below, retains the displacement piece 9 axially upon the percussion tool 4. The percussion tool 4, which may, for example, be constructed as a hollow chisel, is driven forwards together with the displacement piece 9, the spring 5 being compressed, when a blow is applied in a forward direction onto the spigot 7. While the chisel-like portion of the percussion tool 4 serves for shattering stones, the function of the displacement piece 9 is to deflect the soil sideways and to form a hollow chamber having a compacted lateral wall, so that during the advance of the percussion boring device 1, a tunnel with a compacted wall is formed, into which a supply line can be pulled-in either simultaneously or later on.

Inside the tubular housing 2, a percussion piston 14 is axially reciprocable. For this purpose, the percussion piston 14 has forward and rear guide rings 15, 16, with slide rings 17, 18 set in them. Whereas the rear guide ring 16 needs to be completely sealed to the housing 2 by means of the slide ring 18, the forward guide ring 15 possesses one or more axial grooves 19, so that during a longitudinal displacement of the percussion piston 14, the air expelled in its forward part can flow backwards over its surface. In the rear part, the percussion piston 14 is provided with an internal cylindrical chamber 21, which is bounded by a percussion piston sleeve wall 22. Control ports 23 are distributed around the circumference of this wall, these ports constituting a flow connection between the cylinder chamber 21 or the atmosphere and the forward space in front of the percussion piston 14.

A control piston 24, which in operation is axially stationary, extends from behind into the internal cylindrical chamber 21 of the percussion piston 14, and compressed air is supplied to this control piston from the rear end of the device 1 via one or more internal ducts 25, this air emerging at the forward face of the control piston 24. The rearward extension of the control piston 24 is held in a clamp fixing 26, which has axial air passages 27 at its circumference. At the rear end of the housing 2, the extension of the control piston 24 is connected to a compressed air hose 28, which leads to a compressor, not shown. The compressed air hose 28 is surrounded by a sleeve and a protective tube, not shown.

Figure 2:
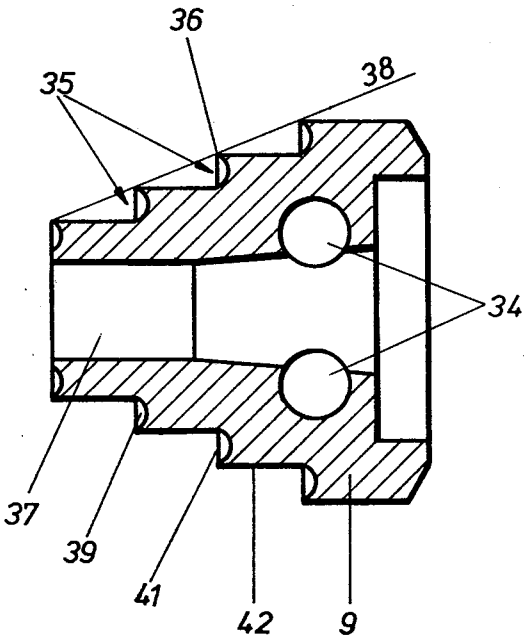
FIG. 2 is an axial section through a displacement piece.

The fixing device 13 already referred to comprises, in the examples shown in FIGS. 1 and 2, retaining cotter pins 32, which engage in an annular semicircular groove 33 formed to extend about the seat 12 and in cylindrical bores 34 of the displacement piece 9.

The displacement piece 9 illustrated in FIG. 2 is provided for a fairly small boring device 1. In this example, four step-shaped cutters 35, disposed one behind another, are disposed around the outer periphery of the displacement piece 9. The cutting edges 36 of these cutters, which are situated upon the outermost circumference of the cutters, lie upon a straight line 38, as seen in axial section, extending forwards towards the central axis 37 of the displacement piece 9. Each cutter 35 has an annular concave undercut 39. The ratio between the radial height 41 of each cutter 35 and the axial length 42 of each cutter is about 1:3. The cutters 35 are formed integrally with the displacement piece 9.

Figure 3:
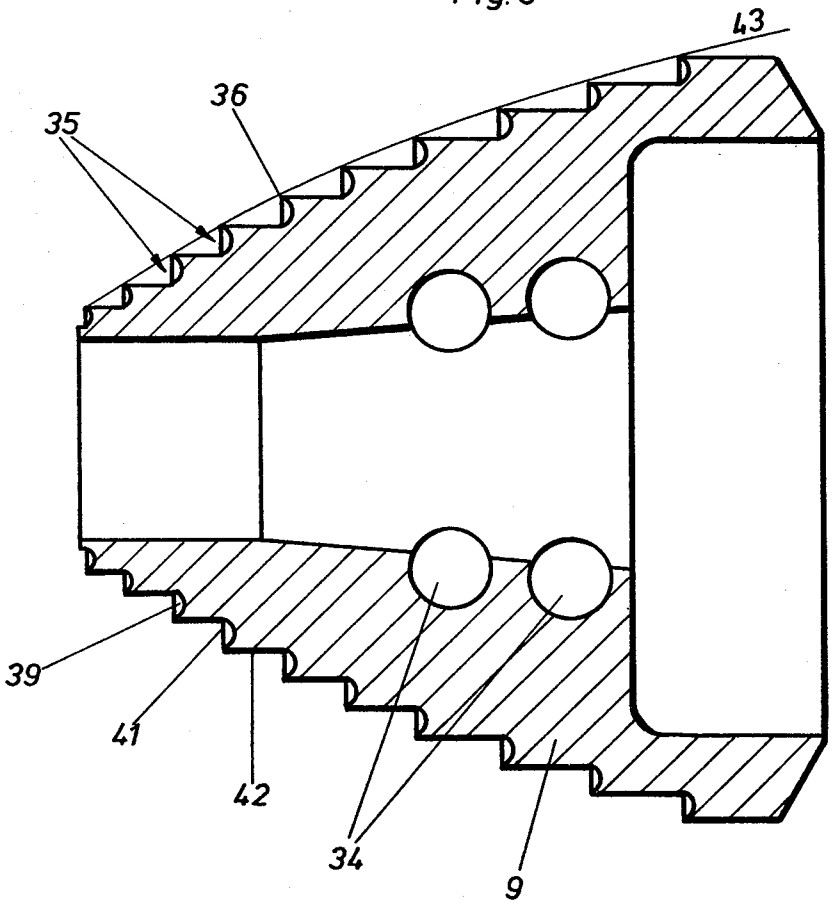
FIG. 3 is an axial section through another displacement piece.

The displacement piece 9 illustrated in FIG. 3 is formed basically like the displacement piece 9 shown in FIG. 2, with the difference that in the example of FIG. 3, the displacement piece is suitable for a larger percussion boring device 1. The displacement piece 9 also has a number of cutters 35 around its external periphery. Another difference from the first example lies in the fact that the radial heights 41 and axial lengths 42 of the cutters 35 increase towards the larger diameter end of the displacement piece 9. Thus, the cutting edges 36 of the individual cutters lie upon a curved line 43 as seen in axial section.

Figure 5:
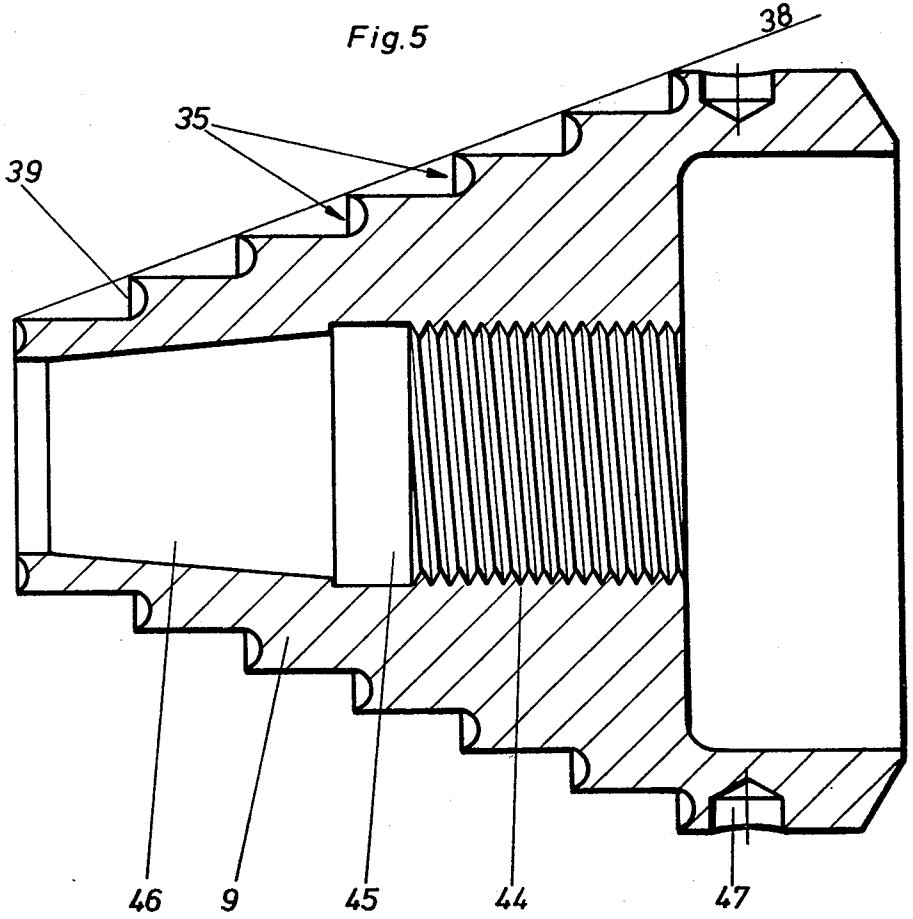
FIGS. 4 and 5 are axial sections through two further somewhat similar displacement pieces.
Figure 4:
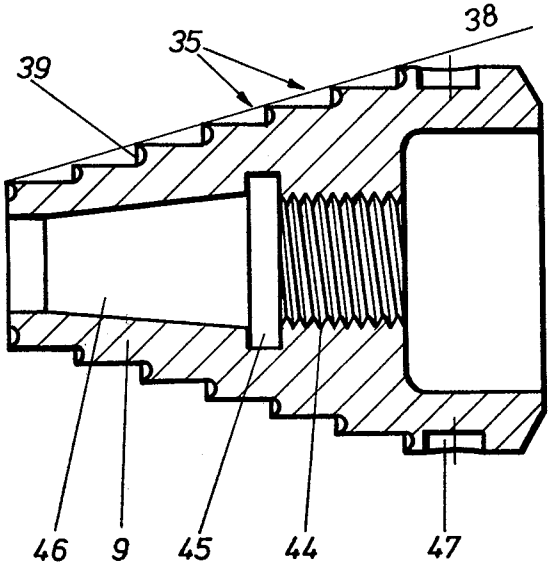

The displacement piece 9 shown in FIGS. 4 and 5 are somewhat longer than those of FIGS. 2 and 3. This is because they have a different fixing 13. The displacement piece 9 in FIGS. 4 and 5 has a screw-threaded mounting bore 44 and a conical bore 46, with an annular recess 45 between them. The displacement piece 9 can thus be tightly screwed onto the percussion tool 4, it being only necessary for this purpose to insert a turning key into blind bores 47 of the displacement piece 9. While this is done, the percussion tool maybe prevented from turning by a conventional spanner engaging flat external faces (not shown) which could be formed behind the blind bores 47.

I claim:

1. A pneumatic percussion earth boring device comprising: a tubular housing having a forward end and a rearward end; a percussive boring tool mounted generally centrally of said housing in said forward end thereof, said percussive boring tool being configured to chisel into an earth formation when said tool is percussively reciprocated in said housing; a percussive piston mounted for reciprocating movement in said housing and adapted upon forward reciprocating movement thereof to act percussively on said boring tool; pneumatic means for reciprocating said piston; a displacement piece mounted on said boring tool for reciprocal motion therewith in order to laterally displace earth about said boring tool when said earth boring device is operating to traverse an earth formation for forming a boring therethrough; and a plurality of cutters on said displacement piece, each of said cutters comprising an annular knife edge extending about said displacement piece, said knife edges of each cutter being spaced apart axially of said boring tool and arranged concentrically thereabout with the diameters of said knife edges increasing stepwise in a direction rearwardly of said displacement piece, and an annular concave undercut portion facing forwardly of said displacement piece extending radially inwardly of said displacement piece from each of said knife edges.

2. A device as claimed in claim 1, wherein said cutters are formed integrally with said displacement piece.

3. A device according to claim 1 wherein said annular knife edges of said cutters are arranged in steps to lie upon a straight line as seen in diametric section taken axially of said displacement piece.

4. A device according to claim 1 wherein said annular knife edges of said cutters are arranged in steps to lie upon a curved line as seen in diametric section taken axially of said displacement piece.

5. A device according to claim 1 wherein said knife edges are spaced from each other radially and axially of said displacement piece, the ratio of said radial displacement to said axial displacement of each of said edges being about 1:3.

6. A device according to claim 1 wherein said knife edges are spaced from each other radially and axially of said displacement piece, said radial displacement of said edges increasing rearwardly of said displacement piece.

* * * * *